US005321378A

United States Patent [19]

Ferullo et al.

[11] Patent Number: 5,321,378

[45] Date of Patent: Jun. 14, 1994

[54] MOLDED CASE CIRCUIT BREAKER CURRENT TRANSFORMER ADAPTER UNIT

[75] Inventors: David A. Ferullo, Bristol; Roger J. Morgan, Simsbury; James L. Rosen, West Hartford; Donna C. DeRosier, Bristol, all of Conn.

[73] Assignee: General Electric Company, New York, N.Y.

[21] Appl. No.: 43,685

[22] Filed: Apr. 8, 1993

[51] Int. Cl.[5] ..... H01H 9/02

[52] U.S. Cl. ..... 335/202; 335/8

[58] Field of Search ..... 335/8–9, 335/10, 18, 131–132, 202, 201, 16, 147, 185; 200/147 R; 361/42–51

[56] References Cited

U.S. PATENT DOCUMENTS

| | | | |
|---|---|---|---|
| 3,812,400 | 3/1974 | Gryctko et al. | 335/18 |
| 4,589,052 | 5/1986 | Dougherty | 361/94 |
| 4,658,323 | 4/1987 | Dougherty | 361/79 |
| 4,679,019 | 7/1987 | Todaro et al. | 335/172 |
| 4,754,247 | 6/1988 | Raymont et al. | 335/202 |
| 4,845,460 | 7/1989 | Manthe et al. | 335/201 |
| 4,884,048 | 11/1989 | Castonguay et al. | 335/18 |
| 5,194,840 | 3/1993 | Frutuoso et al. | 335/202 |

*Primary Examiner*—Lincoln Donovan
*Attorney, Agent, or Firm*—Richard A. Menelly

[57] ABSTRACT

A molded case multi-pole circuit breaker having an electronic trip unit to determine overcurrent conditions connects with a corresponding current transformer within each pole to sample circuit current. Upon the occurrence of an overcurrent condition, a trip actuator is energized to interrupt the circuit current. A current transformer adapter unit supports the trip actuator wire conductors and pin connectors while at the same time shielding the current transformers from the circuit breaker exhaust gases.

10 Claims, 4 Drawing Sheets

MOLDED CASE CIRCUIT BREAKER CURRENT TRANSFORMER ADAPTER UNIT

BACKGROUND OF THE INVENTION

Industrial-rated circuit breakers are available having operating components that are designed for automatic assembly to provide cost improvement as well as improved operating efficiency. The precision alignment performed by the automated assembly equipment allows the operating components within the circuit breaker operation mechanism to be installed within very close operating tolerances. The operating mechanism assembly includes a pair of powerful operating springs that are overcentered for rapidly driving the movable contact arm and the attached movable contact away from the stationary fixed contact to interrupt the circuit current. The operating mechanism includes a cradle operator which engages a latch assembly to prevent the movable contact arm from being driven to its open position under the urgence of the charged operating springs. The compact latch assembly includes a primary and secondary latch operating within a common support structure.

An overcurrent condition is determined within the electronic trip unit such as described within U.S. Pat. No. 4,658,323 and a trip signal is outputted to the trip actuator to articulate the circuit breaker operating mechanism to interrupt the circuit current. The circuit current is sampled continuously through three current transformers one for each of the three current phases. The trip actuator is described within U.S. Pat. No. 4,679,019 and the current transformers are described within U.S. Pat. 4,884,048. To protect the current transformers from the debris resulting from the arc gases generated under intense overcurrent interruption, the three current transformers within the three-pole circuit breakers are encapsulated together in a plastic composition and are inserted within the circuit breaker case as a single unit. This requires a different-sized current transformer unit for each circuit breaker frame size since the circuit breaker enclosures increase in size according to the ampere rating requirements with each frame.

Since the individual current transformers are capable of use within the various frame sizes without modification, it has been determined that a substantial cost savings can be realized if the current transformer arrangement described within the aforementioned U.S. patent could be simplified.

Accordingly, one purpose of this invention is to describe an arrangement wherein the current transformers used within circuit breakers employing electronic trip units can be individually mounted within the circuit breaker enclosures of various ampere ratings without encapsulating the current transformers as a single unit.

SUMMARY OF THE INVENTION

A current transformer adapter unit is arranged between the circuit breaker current transformers arranged within each phase of a multi-phase circuit breaker to support the trip unit actuator wire conductors and to shield the current transformers from the circuit breaker exhaust arc gas by-products. The adapter unit is in the form of a plastic U-shaped strip with a wire channel formed on one side and with a pair of pin connectors extending through the top part. The wire conductors connecting the electronic trip unit with the trip unit actuator are arranged through the wire channel and are electrically-connected with pin connectors.

DESCRIPTION OF THE PREFERRED EMBODIMENT

Figure 1:
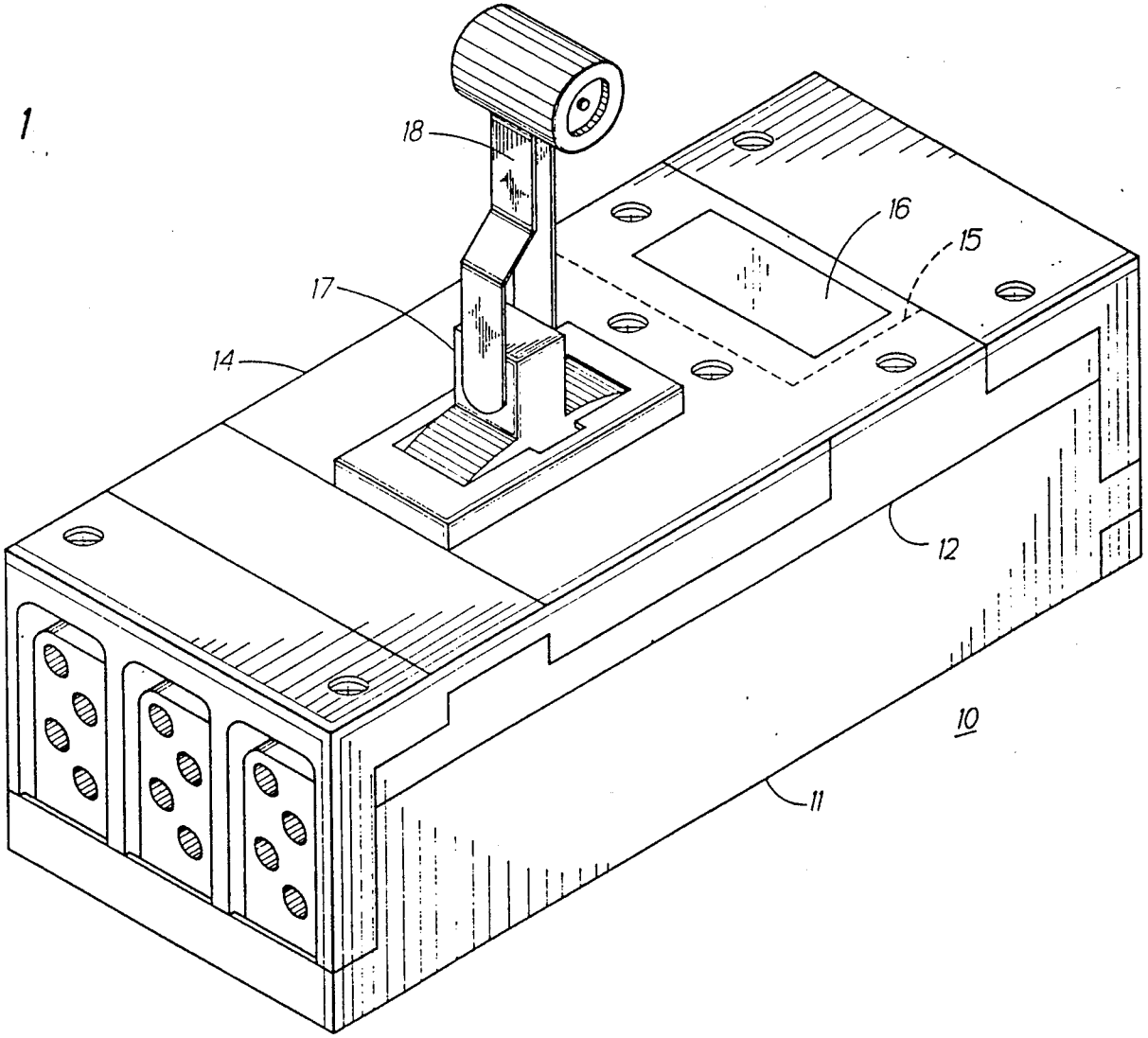
FIG. 1 is a top perspective view of a molded case circuit breaker containing the current transformer adapter unit according to the invention.

An industrial-rated circuit breaker 10 is depicted in FIG. 1 and consists of a molded plastic case 11 to which a molded plastic cover 12 is securely fastened. An accessory cover 14 such as described within U.S. Pat. No. 4,754,247 is used to provide access to the various circuit breaker accessories that are completely field-installable. An electronic trip unit 15 under the access plate 16 is also arranged within the circuit breaker cover for providing overcurrent determination as well as electronic accessory function. One such electronic trip unit is described within U.S. Pat. No. 4,589,052. The circuit breaker operating handle 17 and extender 18 are used to manually turn the circuit breaker between its ON and OFF conditions.

Figure 2:
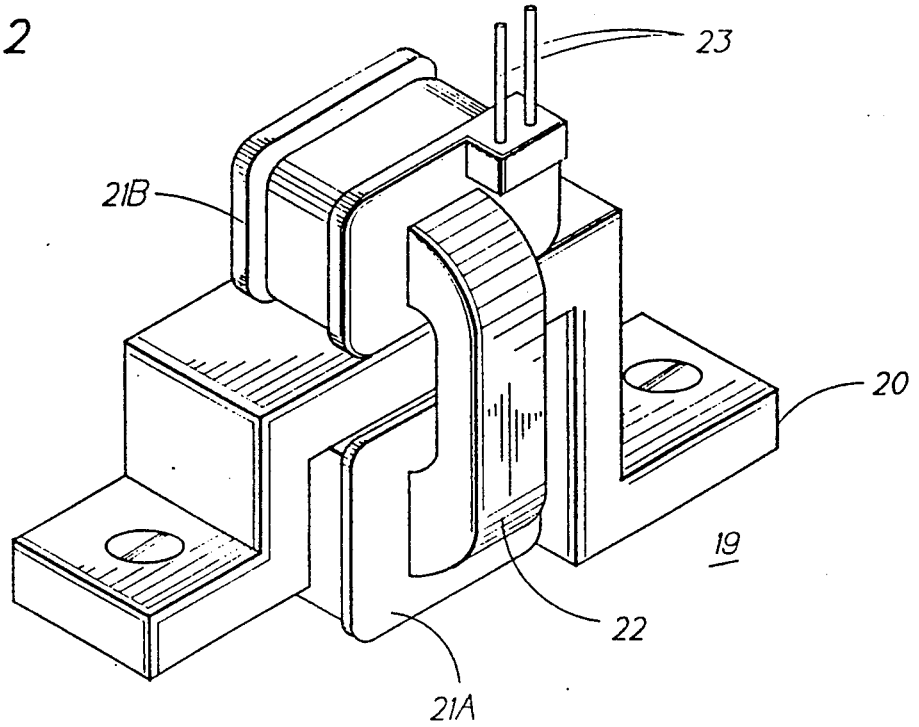
FIG. 2 is an enlarged top perspective view of a current transformer prior to insertion within the circuit breaker according to the invention.
Figure 3:
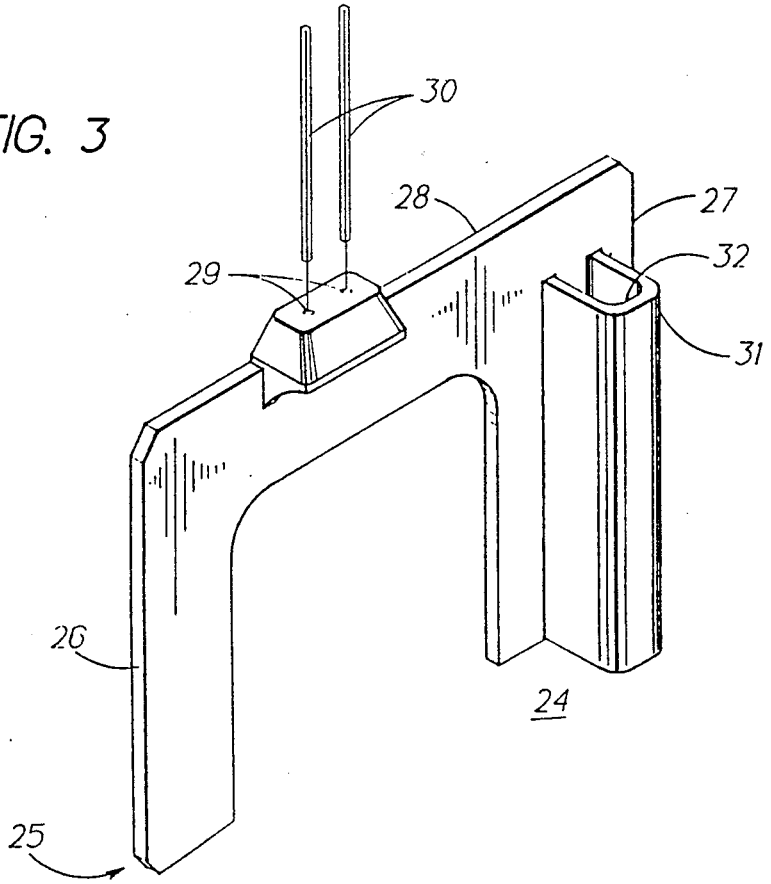
FIG. 3 is a top perspective view of the current transformer adapter unit of this invention with the pin connectors in isometric projection.

As described in the aforementioned U.S. Pat. No. 4,589,052, a current transformer is used within each phase of the protected circuit to sample circuit current on a continuous basis. One such current transformer 19 is shown in FIG. 2 and consists of a copper strap 20 which passes through the core 22. The transformer secondary windings are indicated at 21A, 21B, respectively. As described in U.S. Pat. No. 4,884,048, a pair of pin connectors 23 extend from a top part of the transformer to provide electric connection between the transformer secondary windings and the electronic trip unit. In order for one such current transformer to be used as a single unit within each phase of the circuit breaker internal circuit, the current transformer adaptor unit 24 hereafter "adapter unit" depicted in FIG. 3 is required.

The adapter unit 24 basically consists of a U-shaped plastic support strip or unit 25 having a pair of legs 26, 27 descending from a top cross piece 28 as indicated. A pair of apertures 29 are formed within the top cross piece 28 to receive a pair of pin connectors 30 in press-fit relation such that the bottom parts of the pin connectors are inserted within the apertures and the remainder of the pin connectors extend above the top cross piece. A wiring channel 31 is integrally-formed within the leg 27 to define a wire raceway 32. The adapter unit provides protection to the current transformers by intercepting, cooling and de-ionizing the arc gases described earlier and serve to support and protect the wires that connect with the electronic trip unit in the manner to be described below.

Figure 4:
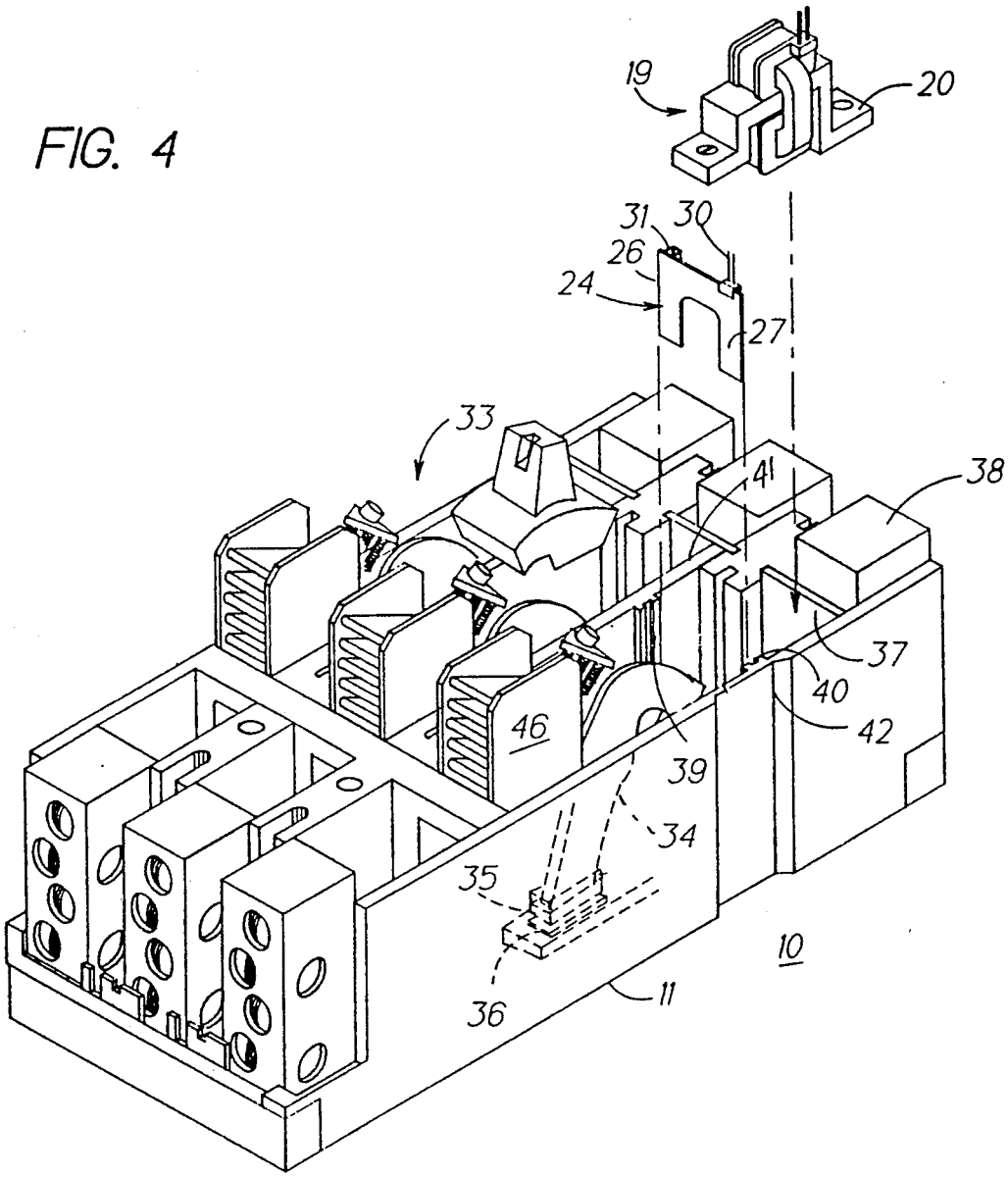
FIG. 4 is a top perspective view of the circuit breaker of FIG. 1 with the cover removed and with the current transformer and current transformer adapter unit depicted in isometric projection.

Before describing the positioning of the current transformer 19 in the current transformer compartment 37 as depicted in the circuit breaker 11 of FIG. 4, it is helpful to review the operation of the circuit breaker operating mechanism 33 to interrupt circuit current by driving the movable contact 35 on the movable contact arm 34 away from the fixed contact 36. The intense arc that occurs upon contact separation is cooled and de-ionized within the arc chutes 46 arranged over the contacts within each pole. To prevent the debris generated by the arc from reaching the current transformers 19, the adapter unit 24 is inserted within the slots 39, 40, formed within the inner walls 41 and side walls 42 of the circuit breaker case 11 between the operating mechanism and the current transformers. The legs 26, 27 are inserted in the position shown in FIG. 4 such that the pin connectors 30 extend in the upright position and the wiring channel 31 is outboard the operating mechanism and abuts the current transformer 19. After insertion of the adapter units, the current transformers are inserted within the recesses 37 and the current transformer straps 20 are electrically-connected between the load lugs 38 and the movable contact arms 34.

Figure 5:
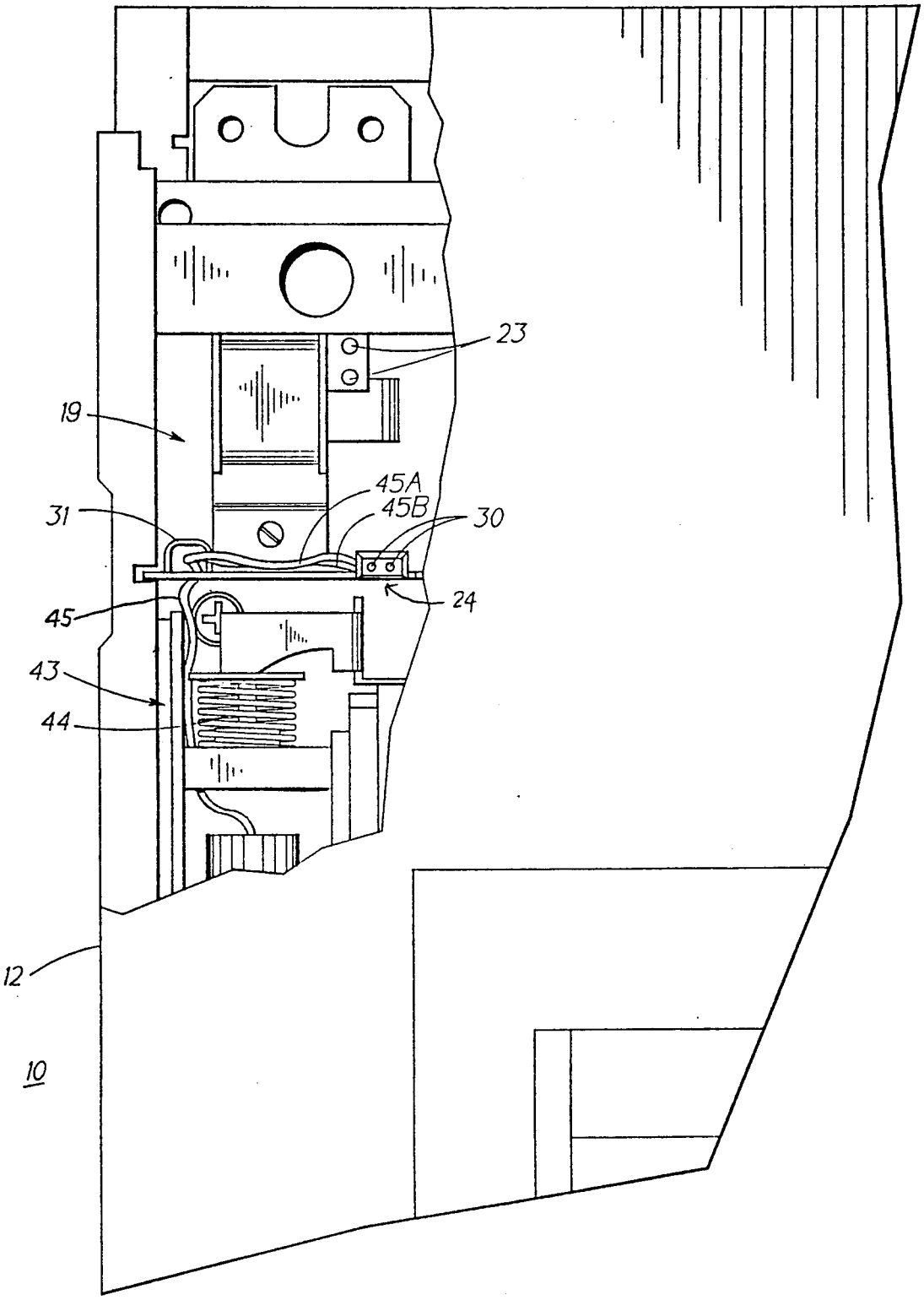
FIG. 5 is a top plan view of the circuit breaker of FIG. 1 with a part of the cover removed to detail the current transformer adapter unit of the invention.

As described within U.S. Pat. No. 4,679,019 a trip actuator unit 43 shown in FIG. 5, interacts with the electronic trip unit 15, shown in FIG. 1, and the operating mechanism 33, shown in FIG. 4 to articulate the circuit breaker operating mechanism to separate the circuit breaker contacts. The trip actuator unit 43 includes an actuator spring 44 for motive force and a two wire conductor cable 45 to connect with the electronic trip unit. The cable passes under the adapter unit 24, as indicated and upwards through the wiring channel 31. The wires 45A, 45B within the cable are welded or brazed to the pin connectors 30 which extend upwards from the adapter unit as described earlier. The electronic trip unit and the transformer pin connections are omitted herein for purposes of clarity but are shown and described within the aforementioned U.S. Pat. No. 4,884,048.

Accordingly, a simple, inexpensive current transformer adapter unit has herein been described which multi-functionally allows the current transformers to be individually arranged within the separate poles of a multi-pole circuit breaker while providing protection from the circuit breaker exhaust arc gases and supporting the trip actuator

Having thus described our invention, what we claim as new and desire to secure by letters patent is:

1. A molded case circuit breaker having an electronic trip unit comprising:

a circuit breaker enclosure including a plastic case and cover enclosing a pair of separable contacts;

an operating mechanism within said enclosure arranged for separating said contacts upon occurrence of an overcurrent condition through a protected circuit;

an electronic trip unit within said enclosure connecting with a plurality of current transformers for sampling circuit current and with a trip actuator for articulating said operating mechanism and separating said contacts; and a current transformer adapter unit intermediate said current transformers and said operating mechanism, said adapter unit shielding said transformers from exhaust gases generated when said contacts become separated during overcurrent conditions, said adapter unit including an aperture formed within a top part thereof and a wire connector pin extending from said aperture cooperating with said current transformer.

2. The molded case circuit breaker 1 wherein said electronic trip unit comprise a printed wire board arranged within said cover.

3. The molded case circuit breaker of claim 1 wherein said current transformers are arranged within said case.

4. The molded case circuit breaker of claim 1 wherein said case comprises a plurality of inner walls and outer walls, each of said inner and outer walls including slots receiving opposite sides of said adapter unit and supporting said adapter unit within said case.

5. The molded case circuit breaker of claim 1 wherein said adapter unit comprises a U-shaped piece having a wire channel formed within one side.

6. The molded case circuit breaker of claim 5 wherein said trip actuator unit includes a wire conductor arranged for connection with said electronic trip unit.

7. The molded case circuit breaker of claim 6 wherein said wire conductors are received within said wire channel.

8. The molded case circuit breaker of claim 7 wherein said wire conductor is electrically-connected to said connector pin.

9. A molded case circuit breaker having an electronic trip comprising: a circuit breaker enclosure including a plastic case and cover enclosing a pair of separable contacts; an operating mechanism within said enclosure arranged for separating said contacts upon occurrence of an overcurrent condition through a protected circuit; an electronic trip unit within said enclosure connecting with a plurality of current transformers for sampling circuit current and with a trip actuator for articulating said operating mechanism and separating said contacts; and a current transformer adapter unit intermediate said current transformers and said operating mechanism, said adapter unit shielding said transformers from exhaust gases generated when said contacts become separated during overcurrent conditions, said adapter unit having an electrically-insulative U-shaped piece having a wire channel formed within one side.

10. The circuit breaker current transformer adapter of claim 9 including a pin connector extending from a top part of said U-shaped piece.

* * * * *